US005431398A

United States Patent [19]

Simpkins

[11] Patent Number: 5,431,398

[45] Date of Patent: Jul. 11, 1995

[54] BALL GAME DEVICE

[76] Inventor: R. Forrest Simpkins, 5903 S. Lee, Apt. 101, Oklahoma City, Okla. 73109

[21] Appl. No.: 203,075

[22] Filed: Feb. 28, 1994

[51] Int. Cl.[6] ..... A63D 15/00; A63B 71/04

[52] U.S. Cl. ..... 273/129 Q; 473/2

[58] Field of Search ..... 273/120 R, 129 R, 129 Q; 473/1, 2

[56] References Cited

U.S. PATENT DOCUMENTS

| | | | |
|---|---|---|---|
| D. 226,275 | 2/1973 | Sanford . | |
| 657,522 | 9/1900 | Dieters et al. . | |
| 1,226,152 | 5/1917 | Weslow | 273/129 Q |
| 1,718,455 | 6/1929 | Craig | 273/129 Q X |
| 3,989,244 | 11/1976 | Wadina | 473/2 |
| 4,097,045 | 6/1978 | Bechtel | 473/129 Q X |
| 5,199,704 | 4/1993 | Badami | 473/2 |

FOREIGN PATENT DOCUMENTS

| | | | |
|---|---|---|---|
| 2538035 | 3/1977 | Germany | 273/129 Q |

*Primary Examiner*—Raleigh Chiu
*Attorney, Agent, or Firm*—Robert K. Rhea

[57] ABSTRACT

A ball game device is formed by an elongated generally upright open end ball receiving tube. In one embodiment the tube has a carom block adjacent its depending end for diverting a ball dropped into the tube in a predetermined lateral direction. In another embodiment the depending end portion of the tube is curved in a lateral ball diverting direction and is supported by a base.

5 Claims, 2 Drawing Sheets

BALL GAME DEVICE

BACKGROUND OF THE INVENTION

1. Field of the invention.

This invention relates generally to game apparatus and more particularly to an upright ball chute device for impelling a cue ball across a horizontal playing surface. The device may be used for determining whether or not the playing surface of a pool table is level.

2. Description Of The Prior Art

I do not know of a patent which is particularly pertinent to this invention. U.S. Pat. No. 657,522, issued Sep. 11, 1900, to Dieters et al for GAME APPARATUS and U.S. Pat. No. Des. 226,275, issued Feb. 6, 1973, to Sanford for POOL TABLE ATTACHMENT FOR PROJECTING CUE BALLS are believed to show the state-of-the-art. The Dieters et al U.S. Pat. No. 657,522, discloses a planar table having a triangular series of recesses in the game surface at one end thereof and a chute forming member at its opposite end in which a ball is rolled toward a carom block for diverting the ball to glance off the side walls of the game board and be received by one of the recesses.

The design patent features a pool table side wall clamp mounting an elongated chute at angle with respect to the horizontal surface of the pool table.

This invention is believed distinctive over these patents by providing a substantially vertically disposed sleeve or tube member which receives and discharges a cue ball in a substantially horizontal direction across a playing surface.

SUMMARY OF THE INVENTION

An elongated sleeve or tube having one curved end portion is rigidly mounted on a generally rectangular base for supporting its other generally upright end portion on an acute angle with respect to the vertical, inclined in a direction opposite the movement of a ball when dropped into the upwardly open end of the tube for projecting the ball across a horizontal playing surface.

In another embodiment the depending curved end portion of the tube is omitted and a carom ledge at the depending end portion of the tube accelerates a cue ball in a horizontal direction across the playing surface when dropped into the tube.

In a further embodiment the base and curved end portion of the tube is omitted and the depending diametrically opposite end portions of the tube wall are cut away to form parallel legs and a downwardly facing shoulder for positioning the tube at the edge of the pool table in which the pool table wall ledge forms a carom surface for accelerating the ball across the pool table surface from one end thereof.

The principal objects of this invention are to provide a tubular passageway for accelerating a cue ball across a playing surface and determining the level condition of the playing surface of a pool table.

DESCRIPTION OF THE PREFERRED EMBODIMENTS

Figure 1:
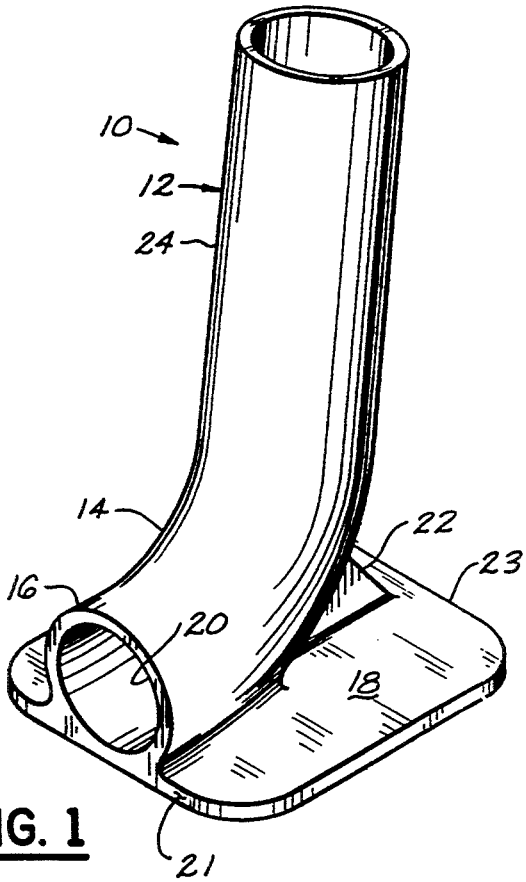
FIG. 1 is a perspective view of one embodiment of the device.

Like characters of reference designate like parts in those figures of the drawings in which they occur.

Figure 2:
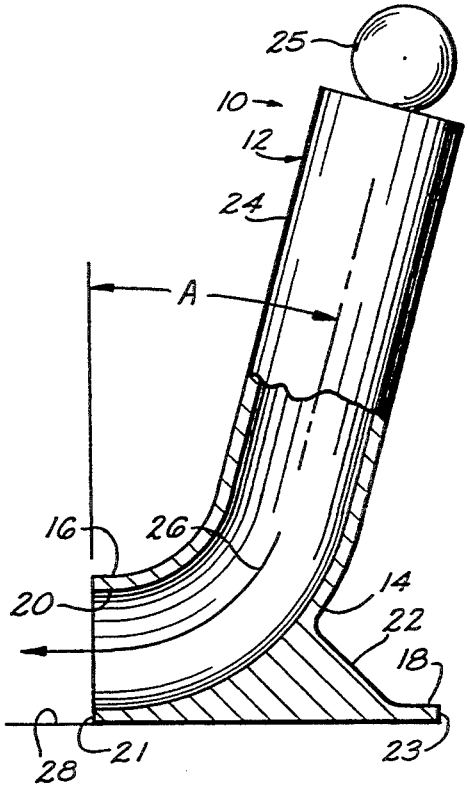
FIG. 2 is a vertical cross section of FIG. 1 partially in elevation.

In the drawings:

Referring first to FIGS. 1 and 2 the reference numeral 10 indicates the device as a whole which is upright tubular in general configuration.

The device 10 comprises an elongated tube 12 having a curve 14 adjacent one end portion 16 which is rigidly secured to a substantially rectangular base 18.

The wall end edge forming the downward and forward outlet end surface of the tube outlet opening 20 is substantially planar with the forward side edge 21 of the base 18 and parrallel with its rearward side edge 23.

A gusset or web 22, interposed between the tube curve 14 and the upper surface of the base, further supports the generally straight major end portion 24 of the tube in a generally upright position, axially preferably disposed at an acute angle A (FIG. 2) of 15° as measured from a vertical axis or 75° as measured from a horizontal axis and an obtuse angle of 105° as measured from a horizontal plane in the direction of a ball exiting the depending open end of the tube inclined rearwardly opposite the direction of the outlet opening 20.

The tube 12 thus forms a downwardly inclined passageway, indicated by the arrow 26, with respect to the base forward and rearward edges 21 and 23, for loosely receiving a spherical object such as a cue ball 25, and accelerating it across a horizontal playing surface, indicated by the numeral 28.

Figure 3:
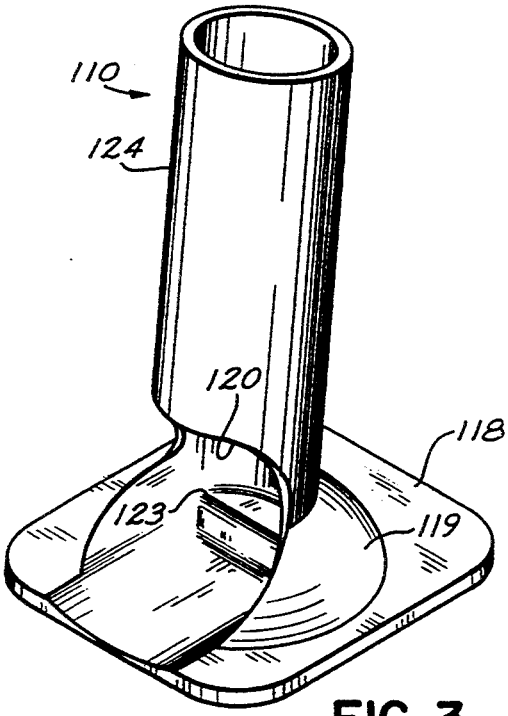
FIG. 3 is a perspective view of another embodiment of the device.
Figure 4:
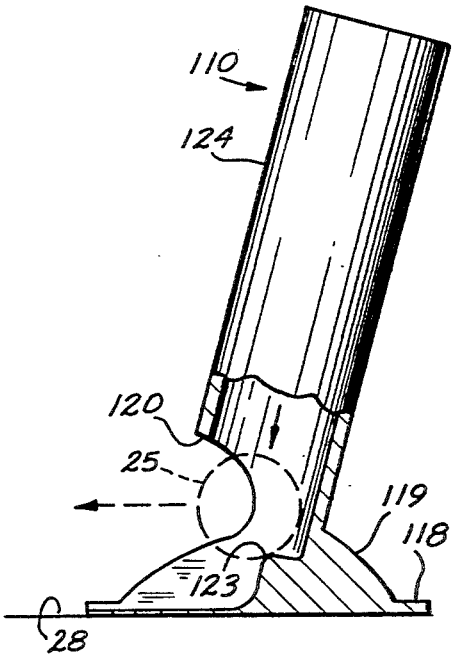
FIG. 4 is vertical cross section of FIG. 3 partially in elevation.

Referring also to FIGS. 3 and 4 the reference number 110 indicates another embodiment of the game device in which the curve 14 and end portion 16 of the embodiment 10 is omitted and the depending straight end portion of the tube 124 is mounted on a similar rectangular base 118.

A central substantially fragmentary hemispherical portion of the base 119 surrounds and is rigidly connected with the depending end portion of the tube 124 to ensure rigidity. The forward depending end portion is cut away to form a lateral and downward wall opening 120 for the exit of a cue ball 25 when dropped into the tube 124 as illustrated by dotted lines (FIG. 4).

The base 118 includes a forward and upward section, at the depending end of the tube 124, which forms a carom ledge 123 subtending an arc of the inner periphery of the tube wall at its juncture with the base on which the ball 25 impacts for accelerating the ball in a forward horizontal direction across the playing surface 28.

Figure 5:
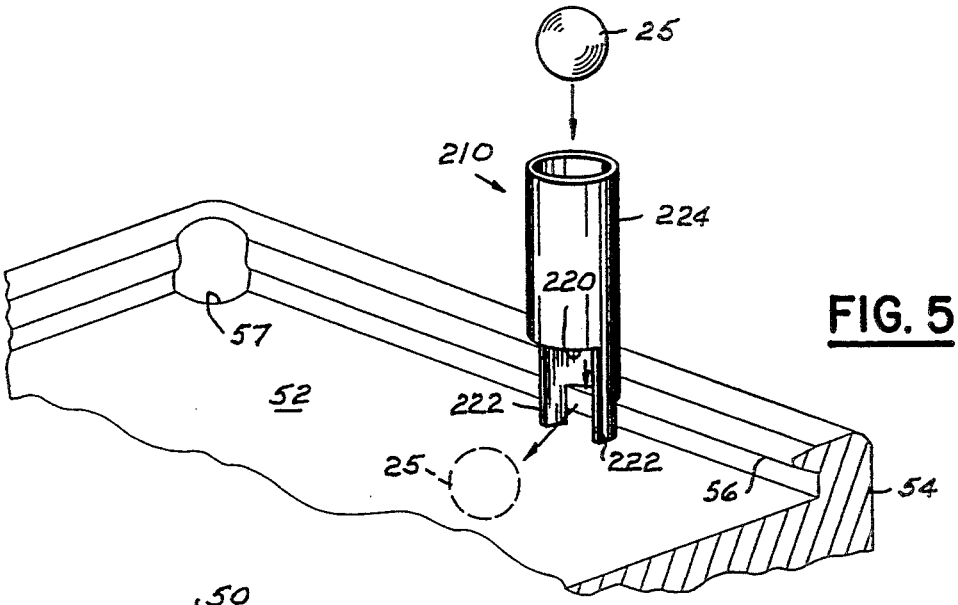
FIG. 5 is a fragmentary perspective view of a pool table illustrating another embodiment of the device when used therewith.
Figure 7:
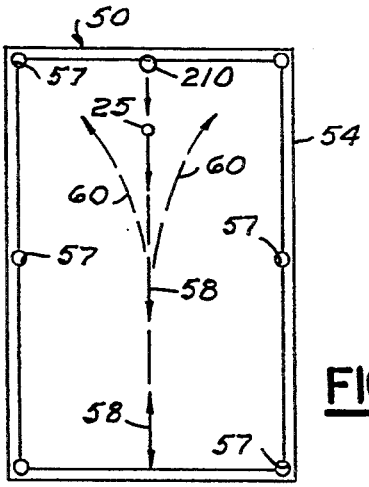
FIG. 7 is a pool table leveling diagram.
Figure 6:
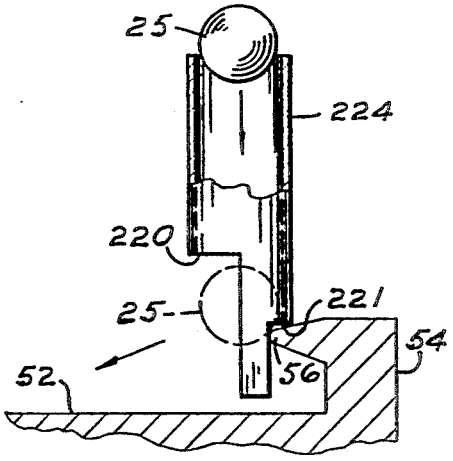
FIG. 6 is fragmentary vertical cross sectional view of a pool table end portion and the ball accelerating embodiment of FIG. 5.

Referring also to FIGS. 5, 6, and 7 the numeral 210 indicates a further embodiment of the game device. The embodiment 210 is particularly useful in testing the level of the playing surface 52 of a pool table 50. A fragmentary end portion thereof is indicated at 50, having the playing surface 52 surrounded by an upstanding continuous side wall 54 terminating inwardly in a overhanging ball carom lip 56 and provided with corner and side pockets. 57.

The apparatus 210 similarly includes a sleeve or tube portion 224 of selected length which has an elongated substantially 180° section of the depending end portion of the tube wall removed, as at 220, to provide space at the depending end portion of the tube wall sufficient to permit the exit of the cue ball 25, when dropped in the tube in the direction of the arrow for deflecting the ball in a lateral direction longitudinally of the table length, for the purpose presently explained.

Similarly the diametrically opposite depending end portion of the tube 224 has a section, substantially 120° of the tube wall removed to form a downwardly facing shoulder or horizontal abutment surface 221 and form a pair of depending wall legs 222 having a length between their depending end surfaces and the abutment surface 221 slightly less than the spacing between the pool table lip 56 and the playing surface 52.

In the operation of the device 210 the tube is manually held vertically, preferably medially with the width of the pool table 50 at one end thereof, with the abutment surface 221 overlying the carom forming lip or edge 56 of the table wall with the adjacent vertical surfaces of the legs 222 contacting the lip 56. While holding the tube vertically a cue ball 25 is manually dropped into the top end of the tube 224 which falling by gravity impacts the carom edge surface 56 which impels the ball in a lateral direction as illustrated by the dotted line and arrow (FIG. 6) with sufficient force to roll to the opposite end of the table 50 in the direction of the arrows 58 and return to its point of beginning.

If the returning ball rolls in the direction of either of the dotted line arrows 60, this indicates that the leg or legs at that side of the pool table 50 are lower than the remaining legs and need adjusting.

Figure 8:
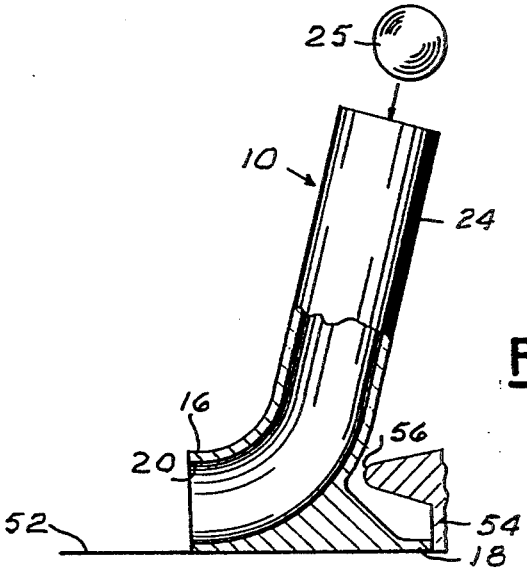
FIG. 8 is a view similar to FIG. 2 illustrating the preferred embodiment when utilized as a pool table leveling guide.

As illustrated by FIG. 8, it seems obvious that the embodiment 10 may be employed in testing the level condition of a pool table playing surface 52. The edge of the base 18 opposite the tube opening 20 is placed in contiguous contact with the inner surface of the pool table wall 54 to insure alignment of the ball passageway 26 with the longitudinal axis of the pool table when the ball 25 is dropped into the tube 24. It also seems obvious that the embodiment 110, particularly as illustrated by FIG. 4 could similarly be used in testing the level condition of a pool table playing surface.

Obviously the invention is susceptible to changes or alterations without defeating its practicability. Therefore, I do not wish to be confined to the preferred embodiment shown in the drawings and described herein.

I claim:

1. A ball game device, comprising:

a generally upright open end tube having an elongated upper end portion and having a horizontally disposed depending end portion;

base means secured to the depending end portion of said tube for supporting the upper end portion of said tube on an incline at an obtuse angle with respect to the horizontal direction of a ball exiting the depending open end of the tube, said tube having a ball outlet opening in its wall adjacent the base means and opposite the inclined direction of the tube upper end portion and, a carom block on said base means subtending an arc of the inner periphery of said tube depending open end.

2. The game device according to claim 1 in which the obtuse angle is not more than 105°.

3. A ball game device, comprising:

a generally upright open end tube having a wall and an elongated upper end portion and a depending end portion; and, guide means at the depending end portion of said tube for guiding a ball exiting the depending end of the tube in a predetermined horizontal direction when released into the upwardly open end of the tube, said tube having diametrically opposite portions of the depending end portion of the tube wall removed to form a pair of parallel legs and at least one downwardly facing part-circular shoulder for supporting said tube on a horizontal ball carom ledge.

4. A cue ball game device, comprising: an elongated generally upright open end tube, said tube having diametrically opposite portions of the depending end portion of its wall removed to form a pair of parallel legs, a lateral ball outlet opening and an opposite downwardly facing part-circular shoulder for supporting said tube on a horizontal ball carom ledge.

5. A cue ball game device for level testing the horizontal playing surface of a pool table, having an upstanding surrounding wall characterized by an inwardly projecting playing surface overhanging lip forming a ball carom ledge, comprising:

an elongated generally upright open end tube having a bore forming a cue ball passageway, said tube having diametrically opposite portions of the depending end portion of its wall removed to form a pair of parallel legs, a lateral ball outlet opening and anopposite downwardly facing part-circular shoulder for supporting said tube on said ball carom ledge, said ledge subtending an arc of the inner periphery of the tube bore for diverting the downward path of travel of a pool table ball when dropped into the tube upward open end in a lateral direction opposite the ledge.

* * * * *